US005816275A

United States Patent [19]

Mullen

[11] Patent Number: 5,816,275

[45] Date of Patent: Oct. 6, 1998

[54] PAINT ROLLER CLEANER

[76] Inventor: Sean Mullen, 177 Saucon Meadow Ct., Bethlehem, Pa. 18015

[21] Appl. No.: 778,578

[22] Filed: Jan. 3, 1997

[51] Int. Cl.[6] ..... B08B 3/02

[52] U.S. Cl. ..... 134/141; 134/153; 134/157; 134/900

[58] Field of Search ..... 134/900, 141, 134/153, 157, 149, 51

[56] References Cited

U.S. PATENT DOCUMENTS

| | | | |
|---|---|---|---|
| 1,261,778 | 4/1918 | Deming | 134/141 |
| 3,070,103 | 12/1962 | Pickard et al. | 134/141 |
| 3,428,060 | 2/1969 | Spivey | 134/900 |
| 3,732,593 | 5/1973 | Habostad | 134/900 |
| 4,130,443 | 12/1978 | Dulin | 134/900 |
| 4,294,272 | 10/1981 | Klaiber | 134/141 |
| 4,311,158 | 1/1982 | Harvey | 134/900 |
| 5,238,012 | 8/1993 | Coronato | 134/900 |
| 5,363,869 | 11/1994 | McDowell . | |
| 5,409,027 | 4/1995 | Glunt . | |
| 5,413,133 | 5/1995 | Russell | 134/900 |
| 5,487,399 | 1/1996 | Hannah . | |
| 5,505,220 | 4/1996 | Gorecki . | |
| 5,507,060 | 4/1996 | Quimpo | 134/141 |

FOREIGN PATENT DOCUMENTS

| | | | |
|---|---|---|---|
| 2407578 | 9/1974 | Germany | 134/900 |

*Primary Examiner*—Frankie L. Stinson
*Attorney, Agent, or Firm*—Terrance L. Siemens

[57] ABSTRACT

A hydraulically powered cleaner for cleaning a paint roller. The cleaner comprises a housing and removable cover which closes and a cleaning chamber within. Water pressure rotates a turbine mounted inside the housing, which turbine in turn rotates the paint roller element. Water is also conducted to a spray manifold which directs jets of water against the roller element at a directly impinging angle. Two valves are disposed within the hydraulic system for individually controlling the turbine and spray manifold. The water system accepts a threaded hose connection for the water supply. Alternatively, an adapting hose is connected, which adapting hose terminates in a flexible, resilient funnel for conducting water from a faucet to the water system of the cleaner. Preferably, hydraulic conduits and components are formed as part of the removable cover.

12 Claims, 2 Drawing Sheets

PAINT ROLLER CLEANER

BACKGROUND OF THE INVENTION

1. Field of the Invention

The present invention relates to cleaning devices utilizing pressurized liquid spray for cleaning articles inserted into these devices. More particularly, the invention relates to a washer which both spins a paint roller and applies forced water spray to the same. The washer obtains water and power from connection to a pressurized supply of water, such as a domestic water system.

2. Description of the Prior Art

Paint rollers are frequently employed for rapid painting surfaces in residential, commercial, governmental, and industrial structures. If the paint is water based, that is, employing water as a solvent, then the roller can be cleaned with water. Cleaning a roller enables the roller to be utilized in subsequent painting. The alternative would be to discard the roller. The cost of rollers can be greatly mitigated by reusing rollers where possible.

Rollers can be cleaned by hand or by automated equipment. Hand cleaning is time consuming and unpleasant. Therefore, it is preferable to utilize automated equipment. A paint roller washer which utilizes pressurized domestic water as a source of both water and power for rotating the roller is seen in U.S. Pat. No. 5,363,869, issued to James McDowell on Nov. 15, 1994. Water sprays from two conduits disposed parallel to the roller. The spray intercepts the roller surface generally tangentially, thereby both rotating the roller and also supplying solvent to carry away paint which has impregnated the roller. By contrast, the present invention has a hydraulic motor which spins the roller. Water is simultaneously sprayed against the exterior of the roller at an angle perpendicular to a tangent to the roller surface. The present invention also includes valves for rotating the roller or washing it from the exterior without performing the other function. This selection is lacking in the prior art since the same stream of water both rotates and washes in McDowell's device.

Other prior art paint roller cleaners include U.S. Pat. No. 5,409,027, issued to Rodney L. Glunt on Apr. 25, 1995, U.S. Pat. No. 5,413,133, issued to Frank A. Russell on May 9, 1995, U.S. Pat. No. 5,487,399, issued to Dale A. Hannah on Jan. 30, 1996, and U.S. Pat. No. 5,505,220, issued to Joseph D. Gorecki on Apr. 9, 1996. All members of this group share the characteristic of rotating the paint roller by water striking the roller surface from the exterior. None has the hydraulic motor of the present invention or the valving scheme of the present invention.

None of the above inventions and patents, taken either singly or in combination, is seen to describe the instant invention as claimed.

SUMMARY OF THE INVENTION

The present invention is a paint roller cleaner which utilizes water pressure to operate. The cleaner has a housing and a removable cover for the housing, a two circuit hydraulic system, valves operating each hydraulic system, and apparatus for attachment to a domestic water supply. The novel cleaner improves over prior art hydraulic paint roller cleaners in two ways. Firstly, a separate hydraulic motor is provided, rather than relying upon water impinging upon the surface of the roller. This feature enables water to be more effectively exploited in rotating the roller, and also enables water to be directed against the roller at a directly intersecting angle rather than a tangential angle. Direct impact of a water jet is more effective in dislodging paint impregnating the roller than is water impinging upon the roller tangentially.

Secondly, the novel cleaner provides the ability to remove paint by pure centrifugal action, without water being employed to wash the roller directly. This occurs when an appropriate valve stops flow to the spray manifold. All the water now acts on the hydraulic motor, which increases rotational speed. No water is directed against the roller. The hydraulic motor can rotate the roller faster than can a jet of water directed tangentially onto the roller surface.

Valves enable selective operation of the hydraulic motor, for rotating the roller, and spraying the roller, or both. When either single function is elected, all incoming water is dedicated to the selected function, with an attendant increase in water pressure acting on the selected function.

The hydraulic system has a threaded socket for connection of a garden hose for supplying domestic water to the cleaner. An optional adapting extension having a funnel is provided for accommodating connection to a faucet, if using a garden hose is not desired.

The housing has a cover which enables nearly total closure of the cleaning chamber. The handle of the roller projects through the housing. Components of the hydraulic circuits are formed as part of the removable cover, so that periodic disconnection and reconnection of the water supply is not required to dump accumulated spent water from the housing.

Accordingly, it is a principal object of the invention to provide a paint roller cleaner which operates automatically by water pressure.

It is another object of the invention to rotate the roller by a hydraulic motor rather than by relying upon jets of water utilized to clean the roller.

It is a further object of the invention to maximize rotational speed of the roller when cleaning.

Still another object of the invention is to direct jets of water for cleaning at an intersecting angle with the roller surface rather than causing tangential contact of the jets with the roller surface.

An additional object of the invention is to enable selection between rotation and spray cleaning functions.

It is again an object of the invention to accommodate connection of a garden hose and of a faucet to the cleaner for supplying domestic water.

A still further object of the invention is to form hydraulic circuit components as part of the removable cover.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
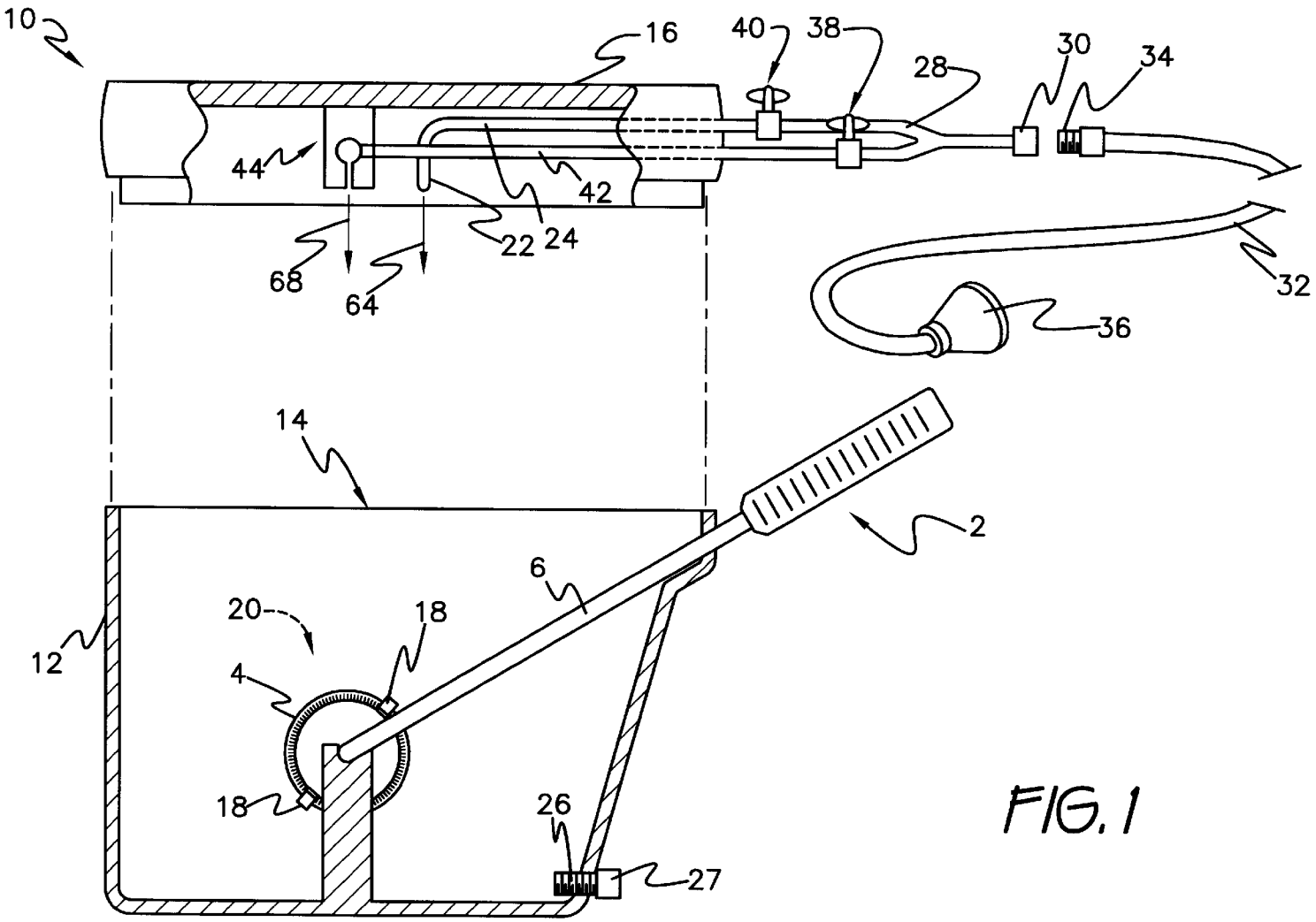
FIG. 1 is an environmental, cross sectional, side elevational view of the invention.

Turning now to FIG. 1 of the drawings, the novel hydraulic cleaner 10 is shown with a paint roller 2 placed therein for cleaning. Cleaner 10 has a housing 12 generally containing a cleaning chamber 14 and a removable cover 16 for closing chamber 14. Paint roller 2 is supported within chamber 14 by its roller element 4 and its handle 6, as will be explained further hereinafter.

Cleaner 10 has a hydraulic motor in the form of a turbine 20 for driving or rotating roller element 4. Roller element 4 is rotatably supported and engaged for driving or rotating by resilient spring clips 18 projecting from turbine 20. Spring clips 18 are disposed to engage the roller from the exterior thereof. Turbine 20 and clips 18 are contained within chamber 14. Turbine 20 utilizes water delivered under ordinary household pressure at nozzle 22 of a water supply conduit 24. After driving turbine 20, water (not shown) escapes from turbine 20, is collected at the bottom of housing 12, and is discharged through drain 26 formed at the bottom of housing 12. Drain 26 is optionally closed by a removable plug 27.

The hydraulic system has two circuits, both supplied from a central conduit 28. Conduit 28 has a threaded receptacle 30 for enabling connection to an external source of water. This source may be an ordinary garden hose (not shown) having a threaded terminal. Alternatively, receptacle 30 may be connected to any convenient faucet (not shown) by optionally utilizing a separate, flexible connection conduit 32 having a threaded terminal 34 compatible with receptacle disposed at one end, and a resilient funnel 36 for adapting connection to the faucet at the other end.

One circuit is devoted to driving turbine 20. Water passes from central conduit 28 through a first cock 40 into conduit 24. Conduit 24 terminates in nozzle 22, which directs discharged water against turbine 20.

Central conduit 28 branches to feed a second circuit utilized to direct washing water against roller element 4. The second circuit is controlled by a second cock 38 controlling liquid communication between central conduit 28 and a spray manifold 44, there being a secondary conduit 42 leading to spray manifold 44. Spraying will be described hereinafter.

Figure 2:
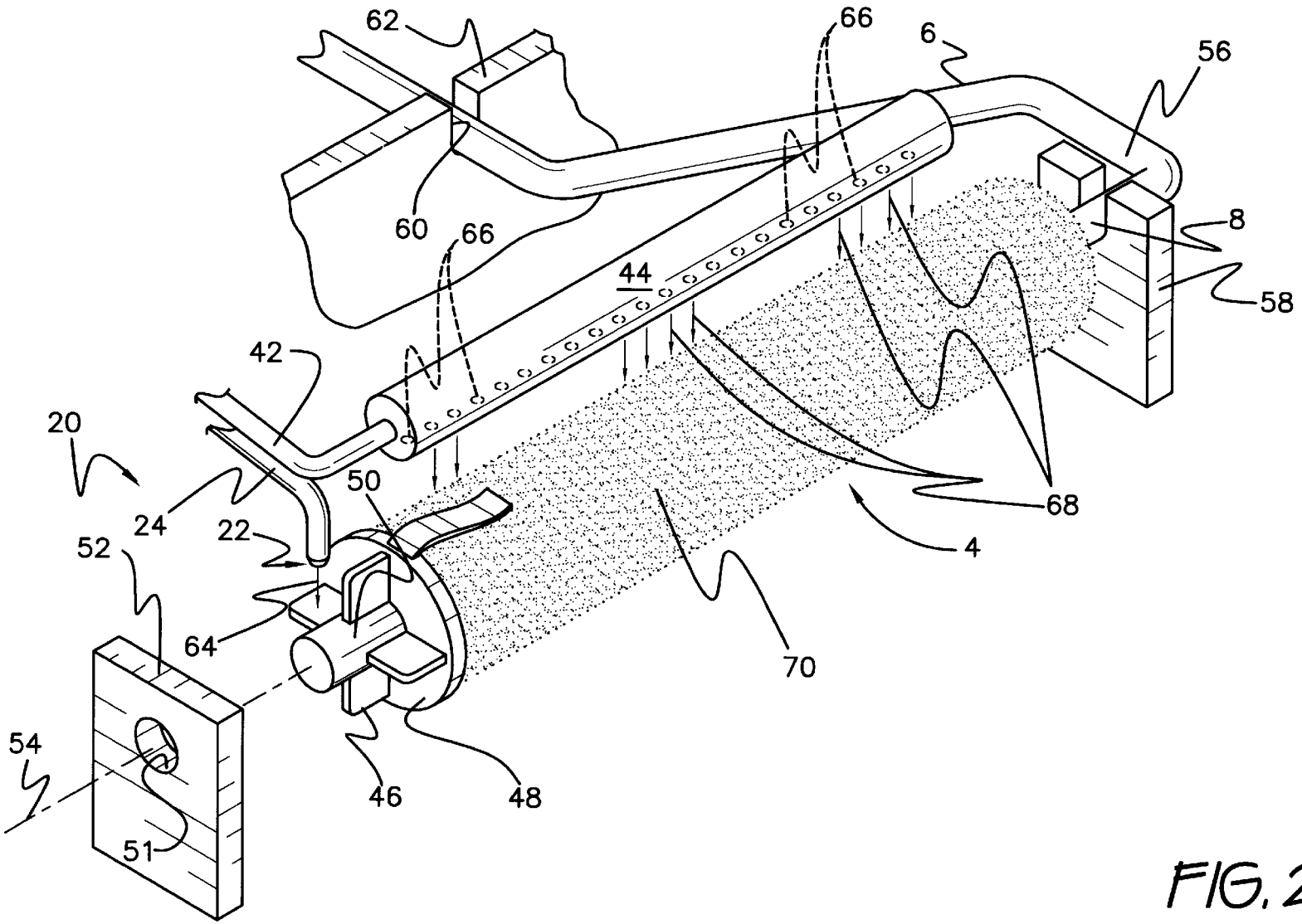
FIG. 2 is an environmental, perspective detail view taken from the center of FIG. 1.

FIG. 2 shows details of the drive system and of the second water circuit for cleaning roller element 4. After passing through cock 40 (see FIG. 1), water passes from central conduit 28 to conduit 24, and then to nozzle 22. Water is ejected at maximum possible velocity through nozzle 22, and impinges upon vanes 46 of turbine 20. Turbine 20 also comprises an end wall 48, which both assists in presenting reaction surfaces to water ejected from nozzle 22, and also supports clips 18. Turbine 20 is of substantially open construction, so that spent water falls down after striking vanes 20 and end wall 48 and collects at the bottom of housing 12.

Turbine 20 further comprises a shaft 50 which is journaled within a bore 51 formed in boss 52. Boss 52 may be formed integrally with a wall of housing 12, the latter being omitted from FIG. 2 for clarity. Shaft 50 has a rotational axis 54 which is coaxial with the rotational axis of roller element 4.

Thus far, description of roller element 4 has included support at only one end. Roller element 4 is supported at the other end by its associated handle 6. The axle portion 8 of handle 6 disposed coaxially with axis 54 is held in a first notch 56 formed in a second boss 58. Boss 58 may also be formed integrally with a wall of housing 12, or in any other suitable way. For example, boss 58 could be axially adjustable, with respect to the axis of the roller, to accommodate rollers of different sizes. Notch 56 is open at the top.

Paint roller 2 is operably placed in cleaner 10 by first inserting the free end of roller element 4 against end wall 48 of turbine 20 and entrapping roller element between clips 18. Clips 18 are disposed at the outer periphery of end wall 48, so that roller 2 is grasped by said clips from the outside of roller 2. Axle portion 8 of handle 6 is then lowered into notch 56. Handle 6 of paint roller 2 is lowered into a second notch 60 formed in rear wall 62 of housing 12. Notch 60 is dimensioned and configured to enable cover 16 (see FIG. 1) to close over handle 6 and substantially seal chamber 14 when placed onto housing 12.

Roller element 4 is now sturdily supported, and can rotate on axle portion 8 of handle 6. Roller element 4 is engaged by clips 18, which resiliently grasp roller element 4 by virtue of being biased to close against rotational axis 54. Cover 16 (see FIG. 1) is lowered into place on housing 12, thereby closing and sealing chamber 14, and cleaning may proceed.

Cleaning is performed by centrifugal action, direct spraying of roller element 4, or both. Opening cock 40 will allow water, after the domestic supply has been connected to receptacle 30, to discharge from nozzle 22 in the direction of arrow 64. Turbine 20 rotates responsive to water discharging from nozzle 22. In turn, turbine 20 rotates or drives roller element 4, thereby subjecting roller element 4 to centrifugal action. If operation of cleaner 10 is confined to utilizing turbine 20, then rotational velocity of roller element 4 will be considerable, and paint may be slung therefrom by centrifugal action.

An advantage of a hydraulic motor is that rotational velocity of the exterior surface of roller element 4 is not necessarily limited to velocity of water ejected from nozzle 22. It should be noted that arrow 64 is directed against vanes 46 in close proximity to shaft 50. The exterior surface of roller element 4 being located at a greater radius from axis 54 than is the point of impact of water striking vanes 46. Thus it follows that this exterior surface can have a velocity greater than that of the point of impact of water against vanes 46.

Turbine 20 thus affords two advantages to cleaning by centrifugal action. One is the relatively great rotational velocity of roller element 4. Another is that since water driving roller element 4 is separated from roller element 4, this water does not adhere to roller element 4 by cohesive force, and therefore does not increase the mass which must be accelerated. To a certain extent, water jets acting directly on roller elements, as occurs in the prior art, will adhere to the roller element and increase effective mass thereof.

Cleaning may also utilize direct spray action. Spray manifold 44 is disposed within chamber 14 proximate turbine 20 and parallel to axis 54. spray manifold has a series of outlet holes 66 directed towards axis 54. Therefore, when water flows through conduit 42 is introduced under pressure into spray manifold 44, this water will impinge as indicated by arrow 68 on exterior surface 70 of roller element 4 when the latter is operably connected to turbine 20. This water will be oriented at an intersecting angle with surface 70. As employed herein, an intersecting angle is understood to signify that the direction of flow is perpendicular to a line tangent to surface 70, and is directed towards axis 54.

It will be seen in FIG. 1 that cocks 38 and 40 are located exteriorly of cover 16. Therefore, each cock 38 or 40 is accessible for individual operation. Spraying and rotating of roller element 4 may be performed individually or simultaneously. This arrangement offers maximal versatility in selecting an effective cleaning procedure. A further advantage is conferred by locating the water circuits within cover 16. That is that cover 16 may be removed from housing 12 to allow housing 12 to be carried to a suitable location for dumping accumulated water and cleaning. The hose or other source of water may be left connected to cover 16, so that disconnection and reconnection of the water supply are not required. It is merely required that cover 16 be replaced on housing 12.

The present invention is susceptible to variations and modifications which may be made by those of skill in the art. The following examples are but a few of the possible variations. The precise orientation of roller element 4 may be arranged as desired, so long as it may be driven by turbine 20 and sprayed by spray manifold 44. Notch 60 could be arranged to accommodate a wide array of different handles of rollers. Turbine 20 may take other forms, such as a positive displacement device. Number and arrangement of clips 18 and vanes 46 may be varied as desired. Housing 12 may be altered to entirely contain paint roller 2, or to contain hydraulic circuits, if desired.

It is to be understood that the present invention is not limited to the embodiments described above, but encompasses any and all embodiments within the scope of the following claims.

I claim:

1. A hydraulic cleaner for a paint roller, comprising:

a housing having a cleaning chamber, a removable cover for closing said cleaning chamber:

drive means for engaging and rotating the paint roller element, disposed within said cleaning chamber, said drive means having a hydraulic motor connected thereto, said hydraulic motor comprising a turbine having vanes; and a supply conduit for conducting pressurized liquid to said hydraulic motor, said supply conduit having a discharge nozzle directing water flowing within said supply conduit to impinge upon said vanes, for rotating said turbine, said turbine contained within said cleaning chamber, said supply conduit having a threaded receptacle for enabling threaded connection of a garden hose to said hydraulic cleaner, for supplying pressurized water thereto, a separate, flexible connection conduit having a threaded terminal compatible with said threaded receptacle disposed at one end of said connection conduit, said threaded terminal for connecting said connection conduit to said threaded receptacle, and a resilient funnel for adapting connection to a faucet at the other end of said connection conduit.

2. The hydraulic cleaner according to claim 1, further comprising a first valve disposed in series with said supply conduit, for controlling liquid communication between said supply conduit and said hydraulic motor.

3. The hydraulic cleaner according to claim 2, further comprising a secondary conduit communicating between said supply conduit and said spray manifold, and a second valve disposed within said secondary conduit for controlling liquid communication between said supply conduit and said spray manifold.

4. The hydraulic cleaner according to claim 1, further comprising a hole formed in said housing, for draining spent water which has accumulated in said housing.

5. The hydraulic cleaner according to claim 1, further comprising a spray manifold disposed within said cleaning chamber proximate said drive means parallel to the axis of rotation of said drive means, said spray manifold having water outlet means directed towards the axis of rotation of said drive means, whereby water introduced under pressure into said spray manifold will impinge upon the surface of a paint roller element operably connected to said drive means at an intersecting angle with the surface of the paint roller, said supply conduit further comprising a secondary conduit communicating between said supply conduit and said spray manifold.

6. The hydraulic cleaner according to claim 1, said housing having means for supporting a paint roller with the roller element of the paint roller contained within said cleaning chamber and the handle of the paint roller projecting to the exterior of said cleaner, said housing having means for closing over the exposed handle when said cover is placed on said housing.

7. A hydraulic cleaner for a paint roller, comprising:

a housing having a cleaning chamber, a removable cover for closing said cleaning chamber;

drive means for engaging and rotating the paint roller element, disposed within said cleaning chamber, said drive means having a hydraulic motor connected thereto, said drive means comprising a turbine having an axis of rotation and an end wall disposed at one end of said turbine and resilient clips disposed upon said end wall at the outer periphery thereof, whereby the roller is grasped by said clips from the outside of the roller;

a spray manifold disposed within said cleaning chamber proximate said drive means parallel to the axis of rotation of said turbine, said spray manifold having water outlet means directed towards the axis of rotation of said turbine, whereby water introduced under pressure into said spray manifold will impinge upon the surface of a paint roller element operably connected to said drive means at an intersecting angle with the surface of the paint roller; and a supply conduit for conducting pressurized liquid to said hydraulic motor, and a second conduit communicating between said supply conduit and said spray manifold, said supply conduit having a threaded receptacle for enabling threaded connection of a garden hose to said hydraulic cleaner, for supplying pressurized water thereto, and a separate, flexible connection conduit having a threaded terminal compatible with said threaded receptacle disposed at one end of said connection conduit, for connecting said connection conduit to said threaded receptacle, and a resilient funnel for adapting connection to a faucet at the other end of said connection conduit.

8. The hydraulic cleaner according to claim 7, said supply conduit further comprising a secondary conduit communicating between said supply conduit and said spray manifold, and said hydraulic cleaner further comprising a first valve disposed in series with said supply conduit, for controlling liquid communication between said supply conduit and said hydraulic motor, and a second valve disposed within said secondary conduit for controlling liquid communication between said supply conduit and said spray manifold;

a hole formed in said housing, for draining spent water which has accumulated in said housing; and a spray manifold disposed within said cleaning chamber proximate said drive means parallel to the axis of rotation of said drive means, said spray manifold having water outlet means directed towards the axis of rotation of said drive means, whereby water introduced under pressure into said spray manifold will impinge upon the surface of a paint roller element operably connected to said drive means at an intersecting angle with the surface of the paint roller.

9. The hydraulic cleaner according to claim 7, said housing having means for supporting a paint roller with the roller element of the paint roller contained within said cleaning chamber and the handle of the paint roller projecting to the exterior of said cleaner, said housing having means for closing over the exposed handle when said cover is placed on said housing.

10. A hydraulic cleaner for a paint roller, comprising:

a housing having a cleaning chamber, a removable cover for closing said cleaning chamber;

drive means for engaging and rotating the paint roller element, disposed within said cleaning chamber, said drive means having a hydraulic motor connected thereto means for supporting the roller by its handle, comprising a boss having a notch open at the top, said boss being axially adjustably positioned within said housing; and a supply conduit for conducting pressurized liquid to said hydraulic motor, said supply conduit having a threaded receptacle for enabling threaded connection of a garden hose to said hydraulic cleaner, for supplying pressurized water thereto, and a separate, flexible connection conduit having a threaded terminal compatible with said threaded receptacle disposed at one end of said connection conduit, for connecting said connection conduit to said threaded receptacle, and a resilient funnel for adapting connection to a faucet at the other end of said connection conduit.

11. The hydraulic cleaner according to claim 10, said supply conduit further comprising a secondary conduit communicating between said supply conduit and said spray manifold, said hydraulic cleaner further comprising a first valve disposed in series with said supply conduit, for controlling liquid communication between said supply conduit and said hydraulic motor, and a second valve disposed within said secondary conduit for controlling liquid communication between said supply conduit and said spray manifold;

a hole formed in said housing, for draining spent water which has accumulated in said housing; and a spray manifold disposed within said cleaning chamber proximate said drive means parallel to the axis of rotation of said drive means, said spray manifold having water outlet means directed towards the axis of rotation of said drive means, whereby water introduced under pressure into said spray manifold will impinge upon the surface of a paint roller element operably connected to said drive means at an intersecting angle with the surface of the paint roller.

12. The hydraulic cleaner according to claim 10, said housing having means for supporting a paint roller with the roller element of the paint roller contained within said cleaning chamber and the handle of the paint roller projecting to the exterior of said cleaner, said housing having means for closing over the exposed handle when said cover is placed on said housing.

* * * * *